United States Patent [19]

Robbins

[11] 3,976,228

[45] Aug. 24, 1976

[54] LIQUID STORAGE SYSTEM

[76] Inventor: Allen Blaine Robbins, 4615 Macky Way, Boulder, Colo. 80303

[22] Filed: Dec. 5, 1974

[21] Appl. No.: 529,870

[52] U.S. Cl. ..... 222/143; 222/145; 222/481; 206/504; 137/571

[51] Int. Cl.[2] ..... B65D 21/00; B67D 5/60

[58] Field of Search ..... 222/143, 145, 487; 206/504, 509, 511; 220/23.4, 23.6; 137/571

[56] References Cited

UNITED STATES PATENTS

| | | | |
|---|---|---|---|
| 494,061 | 3/1893 | Day | 222/145 |
| 2,080,602 | 5/1937 | Chamberlin | 222/481 X |
| 3,374,917 | 3/1968 | Troy | 220/23.4 |

FOREIGN PATENTS OR APPLICATIONS

| | | | |
|---|---|---|---|
| 2,115,693 | 10/1972 | Germany | 206/504 |
| 2,125,266 | 11/1972 | Germany | 222/145 |
| 963,494 | 7/1964 | United Kingdom | 206/504 |

*Primary Examiner*—Stanley H. Tollberg
*Assistant Examiner*—Frederick R. Handren
*Attorney, Agent, or Firm*—Robert E. Harris

[57] ABSTRACT

A storage container is disclosed as well as a liquid storage system. Each container has walls of thin plastic material with the top and one sidewall of each container including a plurality of protuberances and the bottom and other sidewall including a plurality of indentations complementary to the protuberances so that, when like storage containers are brought into adjacent relationship, protuberances in one wall of one container are received in and mate with the indentations in one wall of the other container to facilitate maintaining vertical stacking and/or abutting side-by-side relationship of the system. The protuberances and indentations preferably have complementary slanting walls and each container wall preferably includes three such protuberances or indentations which are of substantial dimensions to also strengthen said walls. Piping is provided to interconnect the containers of the storage system and includes air conduit means opening into the top portion of each container and liquid conduit means opening into the bottom portion of each container, with liquid being withdrawn from the bottom portion of each container.

7 Claims, 6 Drawing Figures

LIQUID STORAGE SYSTEM

FIELD OF THE INVENTION

This invention relates to a liquid storage system and more particularly relates to particular interconnected storage containers providing such a system.

BACKGROUND OF THE INVENTION

It is often times necessary, or at least desirable, that storage systems be established and maintained. The storage of various liquids for later use is one example and the storage of water is of particular interest.

While water might be stored in large storage tanks, this is not always practical, particularly where individual or family storage facilities are concerned. While liquid such as water creates a weight and/or portability problem such that large tanks are often impractical for such storage purposes, smaller containers also offer a disadvantage since inadequate or at least inconvenient supplies often result.

While it has been suggested that smaller containers could be utilized for storage, including liquid storage, and physically structured to aid in stacking a plurality of containers, no practical system has been developed for a plurality of containers to interconnect the same so that the contents may flow therebetween yet the containers are maintained securely in abutting relationship and may be quickly disconnected from the system and removed.

Containers with various types of stacking features are shown, for example, in U.S. Letters Pats. 3,759,416, 3,586,204, 3,489,314, 3,455,480, 3,424,334, 3,391,824, 3,389,830, 3,346,137, 3,117,692, 3,084,830, and 2,595,113.

SUMMARY OF THE INVENTION

This invention provides a storage system suitable for securely maintaining a plurality of containers in abutting and stacked relationship with the containers interconnected so that liquid within the containers can be withdrawn from a common outlet. In addition, a light container of plastic is utilized to store liquids such as water with each container having protuberances and indentations in the walls thereof to facilitate secure maintenance of the containers in abutting and/or stacking relationship with piping between containers being included at one end wall of each container.

It is therefore an object of this invention to provide an improved storage container having protuberances and indentations in selected walls thereof.

It is another object of this invention to provide an improved storage container having access means to the interior thereof for interconnection of a plurality of like containers.

It is still another object of this invention to provide an improved storage container of thin plastic material suitable for storing liquids such as water.

It is yet another object of this invention to provide a liquid storage system that includes a plurality of storage containers with walls adapted for securely stacking said containers and maintaining the same in stacked and abutting relationship.

It is another object of this invention to provide a liquid storage system that includes a plurality of containers interconnected by means of piping so that the contents of said containers can flow freely therebetween.

It is still another object of this invention to provide a liquid storage system for storing water in convenient fashion suitable for use as a family storage unit.

With these and other objects in view, which will become apparent to one skilled in the art as the description proceeds, this invention resides in the novel construction, combination, and arrangement of parts substantially as hereinafter described, and more particularly defined by the appended claims, it being understood that such changes in the precise embodiment of the hereindisclosed invention are meant to be included as come within the scope of the claims.

BRIEF DESCRIPTION OF THE DRAWINGS

The accompanying drawings illustrate a complete embodiment of the invention according to the best mode so far devised for practical application of the principles thereof, and in which.

DESCRIPTION OF THE INVENTION

Figure 4:
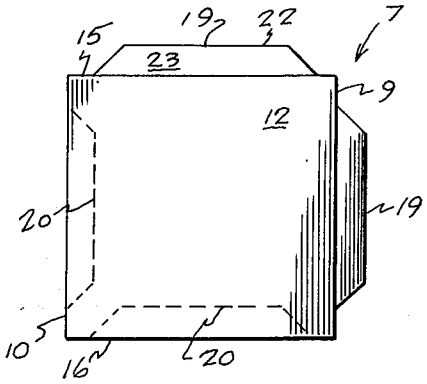
FIG. 4 is an end view of the storage container shown in FIG. 1.
Figure 3:
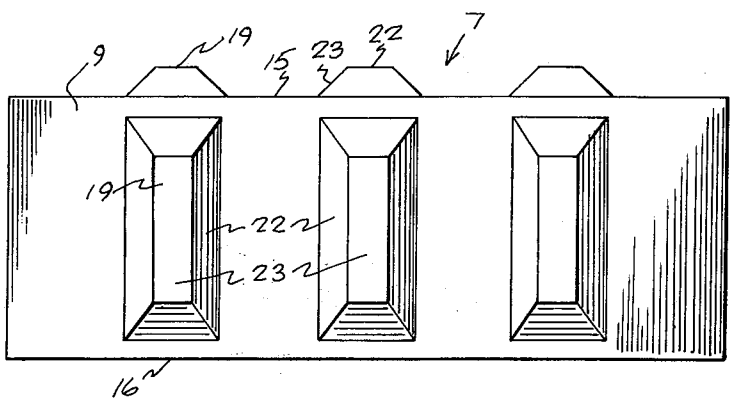
FIG. 3 is a side view of the storage container shown in FIG. 1.
Figure 2:
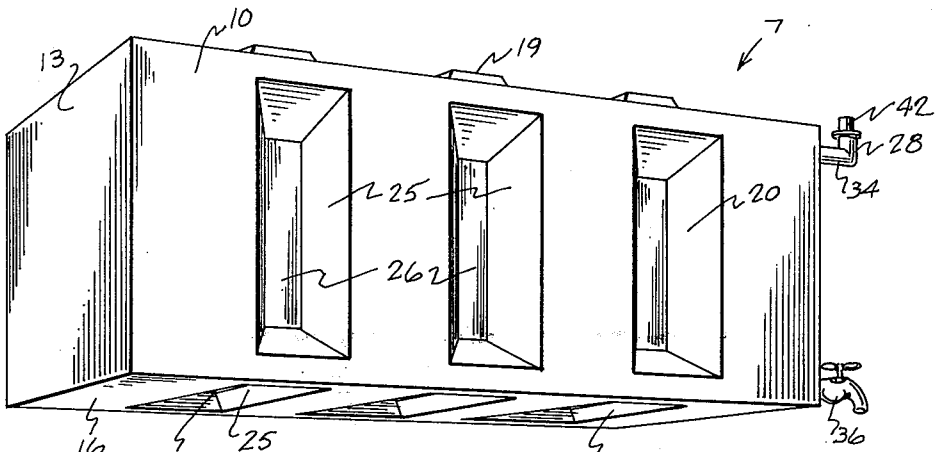
FIG. 2 is a perspective view of the opposite side of the storage container shown in FIG. 1.

Referring now to the drawings, the numeral 7 refers generally to the container, or receptacle, of this invention. As shown in FIGS. 1 through 4, container 7 includes a pair of opposed, substantially flat sidewalls 9 and 10, a pair of end walls 12 and 13, a top wall 15 and a bottom wall 16. As shown, the container walls are preferably integrally formed and are made of thin plastic material.

Figure 1:
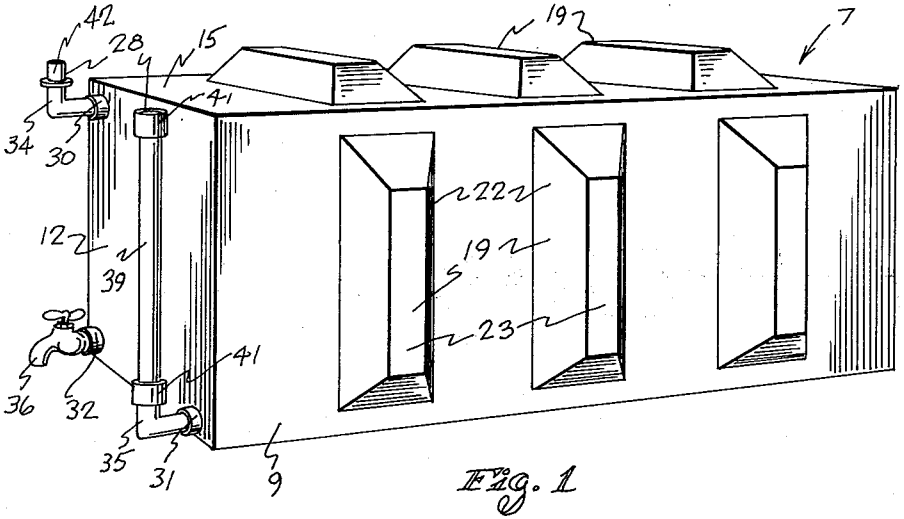
FIG. 1 is a perspective view of the storage container of this invention.

As shown best in FIG. 1, sidewall 9 and top wall 15 have protuberances 19 therein while sidewall 10 and bottom wall 16 have indentations 20 therein. As shown, protuberances 19 extend outwardly from walls 9 and 15, while indentations 20 extend inwardly from walls 10 and 16, and three such protuberances or indentations preferably extend from each wall.

Protuberances 19 each have slanting walls 22 but diverge outwardly from a flat, rectangular top surface 23 to the surface of the walls (9 or 15) from which it extends. In like manner, indentations 20 each have like slanting walls 25 that diverge outwardly from a flat, rectangular bottom surface 26 to the surface of the walls (10 or 16) from which it extends.

Figure 6:
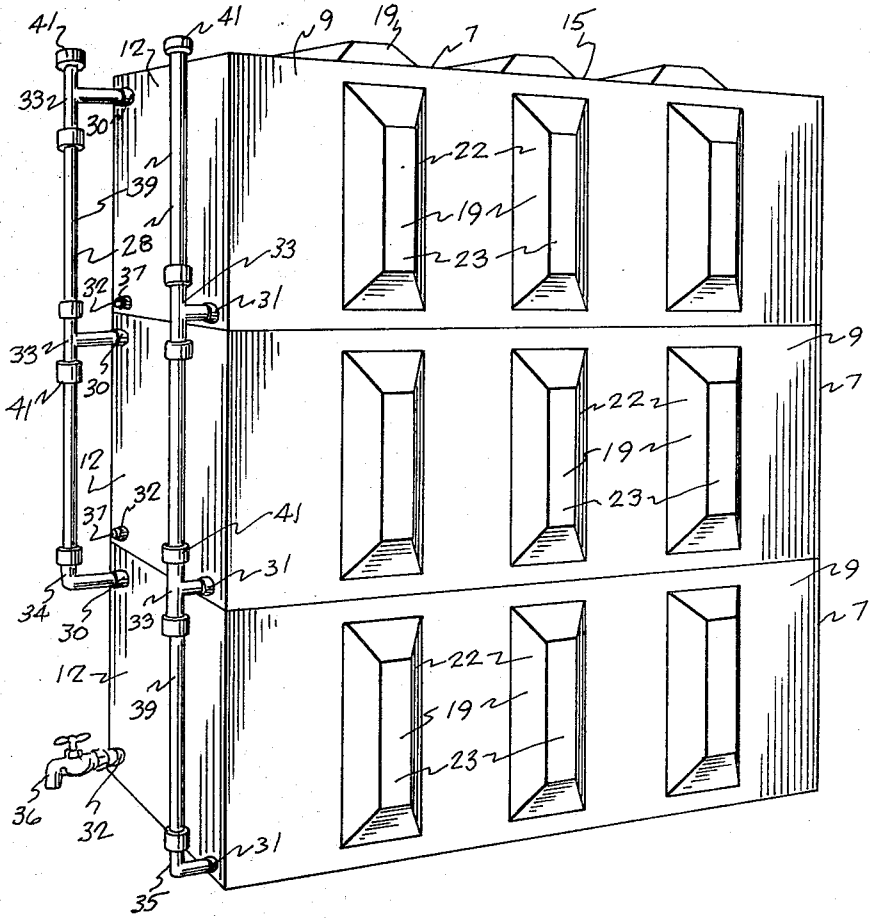
FIG. 6 illustrates the liquid storage system of this invention showing three storage containers stacked and interconnected by piping.
Figure 5:
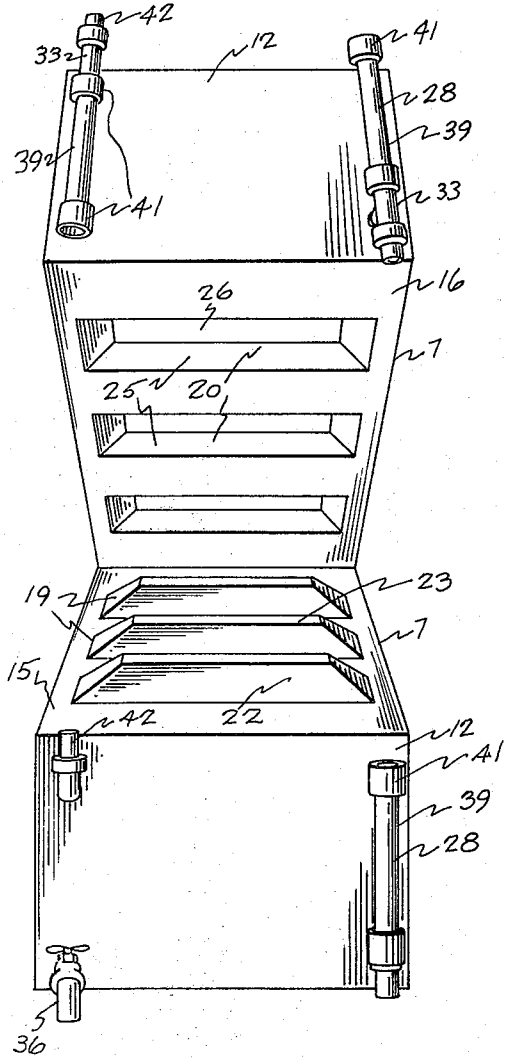
FIG. 5 is a perspective view taken from one end showing two storage containers placed in abutting relationship, the upper container being shown rotated with respect to the lower container to better illustrate the invention.

As shown in FIGS. 5 and 6, the protuberances and indentations are complementary so that, when like containers are brought into abutting relationship, either side-by-side or vertically stacked, the protuberances on one wall of one container are received in and mate with the indentations on one wall of the adjacent container. Thus, the positioning of the containers relative to one another is maintained.

As can be appreciated from the drawings, each protuberance and indentation extends substantially entirely across the container in one direction and the protuberances and indentations are substantially evenly spaced along the container in the opposite direction. While these protuberances and indentations are specifically shown and described herein, it is to be appreciated that different numbers of protuberances and indentations could be utilized as well as other configurations and arrangements as desired or necessary. The use of protuberances and indentations also provide support for the container walls and are preferably of sufficient dimensions so as to extend a distance from the wall at least several times the thickness of the wall itself.

As shown in FIGS. 1, 5 and 6, a piping system 28 is provided for the liquid storage system of this invention. Piping system 28 includes an air passage portion and a liquid passage portion with the air passage portion including fitting 30 that opens into the top portion of container 7 (as shown in FIGS. 1, 5 and 6, fitting 30 is at the top left side of end wall 12 of container 7). The liquid passage includes a fitting 31 that opens into container 7 at the bottom portion (as shown in FIGS. 1, 5 and 6, fitting 31 is at the lower right side of end wall 12 of container 7). In addition, container 7 can also have a second fitting 32 opening into the lower portion for withdrawal of liquid (as shown in FIGS. 1, 5 and 6, fitting 32 is at the lower left side of end wall 12 of container 7).

As shown best in FIG. 6, connection of containers is achieved by piping system 28. To facilitate this interconnection, T-joints 33 are connected with fittings 30 in the air passage line; except for the bottom container 7, no T-joint is needed in the bottom container, so an elbow 34 has been substituted. In like manner, T-joints 33 are also used in the liquid passage line and connect with fittings 31, except again at the lower container, elbow 35 has been substituted.

Liquid may be withdrawn from the storage system in any convenient manner, as by faucet 36, for example. If each container has a fitting 32, a plug 37 may be utilized to plug the same since liquid need only be withdrawn from the lower container through faucet 36 with the upper container emptying first due to gravity and the interconnection between the containers.

The containers 7 are interconnected by means of connecting tubes 39 with connecting fittings 41 being connected at the top of the liquid and air passage lines. In addition, a nipple 42 can be provided at air passage line to open the line to the atmosphere while fitting 41 can be connected to any convenient water supply source (not shown) to fill the containers. When filled, a fitting 41 in the liquid supply line is disconnected from the water supply source, then it should be capped.

In operation, a plurality of containers 7 are placed in side-by-side and/or vertical stacking positions abutting one another with the protuberances and indentations in mating relationship between containers. The vertical-stacked containers are then interconnected by means of the piping system 28 and the containers filled with liquid. The containers then store the liquid, preferably water, until needed with the water being withdrawn as needed through faucet 36. As many containers are utilized as needed and/or as space permits and, if desired, conventional valves (not shown) can be utilized in each section to automatically cut the flow of liquid if part of the tubing is removed. In addition, again if desired, the side-by-side containers could be interconnected in the same manner as suggested for the vertical stacked arrangement. The protuberances and indentations in each container thus not only strengthen the container walls, they also fix and maintain the relationship and relative positioning between containers and this makes storage more secure and facilitates interconnection between containers by the piping system.

This invention thus provides an improved liquid storage system as well as an improved container that is readily adaptable for storage purposes.

What is claimed is:

1. A liquid container, comprising: substantially flat first and second walls one of which has a plurality of protuberances therein of predetermined configurations and the other of which has a like plurality of indentations therein with configurations complementary to that of said protuberances so that identical containers placed in abutting relationship have said first and second walls contiguous to one another with said protuberances mating with and being tightly received in said indentations; a plurality of walls joining said first and second walls to form a closed container suitable for storing liquids; and conduit means opening into one of said plurality of walls for supplying liquid to said container and withdrawing liquid therefrom, said conduit means being adapted to connect with conduit means in abutting like containers to thereby interconnect said containers, and said conduit means including a lower conduit means opening into the bottom portion of said container for handling liquids withdrawn therefrom and upper conduit means opening into the top portion of said container to allow ingress of air into said container as liquid is withdrawn therefrom.

2. The container of claim 1 wherein said first wall has three rectangularly-shaped protuberances therein extending substantially entirely across said wall, and wherein said second wall has three rectangularly-shaped indentations therein extending substantially entirely across said wall.

3. The container of claim 2 wherein said protuberances and indentations have complementary slanting walls.

4. The container of claim 1 wherein said lower and upper conduit means are adapted for separate interconnection with lower and upper conduit means of abutting containers to facilitate interconnection of the same.

5. The container of claim 4 wherein said lower conduit means includes an additional lower conduit for withdrawing liquid from one of a plurality of abutting and interconnected containers.

6. A liquid storage system, comprising: a plurality of abutting containers each of which has a top and first sidewall with a plurality of protuberances therein of predetermined configurations; a bottom and second sidewall with a like plurality of indentations therein of a configuration complementary to that of said protuberances in said top and first sidewalls so that when said containers are brought into contiguous relationship a wall of one of said containers has protuberances that mate with and are received in indentations in the abutting wall of the other of said containers, and walls one of which has first and second access means into the interior of said second container through the top and bottom portions, respectively; and piping means connected to the access means of each said abutting container, said piping means including air conduit means connected with said first access means and liquid conduit means connected with said second access means.

7. A liquid storage system of claim 6 wherein said containers are vertically stacked and wherein said piping means connect said containers so that said upper container empties first, the gravity forces acting on said liquid in said containers.

* * * * *